US009878427B2

(12) United States Patent
Fuchs et al.

(10) Patent No.: US 9,878,427 B2
(45) Date of Patent: Jan. 30, 2018

(54) HAND-HELD POWER TOOL, IN PARTICULAR BATTERY-POWERED SCREWDRIVER

(75) Inventors: Rudolf Fuchs, Neuhausen (DE); Amos Albert, Leonberg (DE); Steffen Petereit, Freiberg (DE); Christoph Koch, Stuttgart (DE); Istvan Szell, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 970 days.

(21) Appl. No.: 14/000,062

(22) PCT Filed: Feb. 14, 2012

(86) PCT No.: PCT/EP2012/052467
§ 371 (c)(1),
(2), (4) Date: Oct. 23, 2013

(87) PCT Pub. No.: WO2012/110485
PCT Pub. Date: Aug. 23, 2012

(65) Prior Publication Data

US 2014/0048298 A1 Feb. 20, 2014

(30) Foreign Application Priority Data

Feb. 18, 2011 (DE) ..... 10 2011 004 364

(51) Int. Cl.
*B25B 21/00* (2006.01)
*B25B 23/14* (2006.01)
(Continued)

(52) U.S. Cl.
CPC ..... *B25B 21/00* (2013.01); *B25B 23/14* (2013.01); *B25B 23/147* (2013.01); *B25F 5/00* (2013.01)

(58) Field of Classification Search
CPC ..... B25B 21/00
(Continued)

(56) References Cited

U.S. PATENT DOCUMENTS 3,985,188 A * 10/1976 Steele ..... B25C 7/00 173/170
5,701,961 A * 12/1997 Warner ..... B25B 21/00 173/15
(Continued)

FOREIGN PATENT DOCUMENTS

DE 43 06 524 A1 9/1994
DE 101 24 674 A1 11/2002
(Continued)

OTHER PUBLICATIONS

International Search Report corresponding to PCT Application No. PCT/EP2012/052467, dated May 10, 2012 (German and English language document) (7 pages).

*Primary Examiner* — Thanh Truong
*Assistant Examiner* — Patrick Fry
(74) *Attorney, Agent, or Firm* — Maginot, Moore & Beck LLP

(57) ABSTRACT

A hand-held power tool includes a drive device in a housing. The drive device is intended to drive a tool accommodated in a tool-accommodating region. An adjusting motion of the hand-held power tool by the user is detected via a sensor device. A controlled variable for setting the drive device is generated in an open-loop or closed-loop control device in the hand-held power tool according to the detected adjusting motion.

21 Claims, 4 Drawing Sheets

(51) Int. Cl.
*B25B 23/147* (2006.01)
*B25F 5/00* (2006.01)

(58) Field of Classification Search
USPC ..... 173/183, 15, 161, 217
See application file for complete search history.

(56) References Cited

U.S. PATENT DOCUMENTS

| | | | | |
|---|---|---|---|---|
| 6,058,815 | A | 5/2000 | Habermehl | |
| 6,199,642 | B1 * | 3/2001 | Becker | B25B 21/00 173/216 |
| 6,923,268 | B2 * | 8/2005 | Totsu | B25B 21/00 173/170 |
| 7,878,090 | B2 * | 2/2011 | Leupert | B25B 21/00 362/119 |
| 8,286,723 | B2 * | 10/2012 | Puzio | B25B 23/0064 173/1 |
| 9,278,437 | B2 * | 3/2016 | Rakaczki | B25B 21/00 |
| 9,475,182 | B2 * | 10/2016 | Ullrich | B25F 5/00 |
| 2011/0203821 | A1 * | 8/2011 | Puzio | B25B 23/0064 173/1 |

FOREIGN PATENT DOCUMENTS

| | | | |
|---|---|---|---|
| DE | 10 2007 019 434 | A1 | 10/2008 |
| EP | 1 302 283 | A2 | 4/2003 |
| EP | 1 369 206 | A1 | 12/2003 |
| EP | 1 895 555 | A2 | 3/2008 |
| WO | 2009/136840 | A1 | 11/2009 |

* cited by examiner

HAND-HELD POWER TOOL, IN PARTICULAR BATTERY-POWERED SCREWDRIVER

This application is a 35 U.S.C. § 371 National Stage Application of PCT/EP2012/052467, filed on Feb. 14, 2012, which claims the benefit of priority to Serial No. DE 10 2011 004 364.0 filed on Feb. 18, 2011 in Germany, the disclosures of which are incorporated herein by reference in their entirety.

The disclosure relates to a hand-held power tool, in particular a battery-powered screwdriver, according to the description below.

BACKGROUND

There are known battery-powered screwdrivers, which, in a housing, have an electric drive motor for driving a tool holder, in which a tool such as, for example, a screwdriver bit, can be inserted. For the purpose of tightening and undoing screws, the battery-powered screwdrivers are provided with a pushbutton switch for regulating the rotational speed, and the battery-powered screwdrivers additionally have a switching means for reversing the direction of rotation. The torque can also be set, via a setting device.

SUMMARY

Proceeding from this prior art, the disclosure is based on the object of realizing a hand-held power tool such that precise working of workpiece is achieved in an ergonomic manner.

This object is achieved, according to the disclosure, with the features described below. The following description specifies expedient developments.

The hand-held power tool according to the disclosure is, for example, a drill, a hammer drill or a screwdriver such as, for example, a battery-powered screwdriver or battery-powered drill, wherein also possible, in principle, are other hand-held power tools that have a drive motor, preferably an electric drive motor, in a housing, for driving a tool holder in which a tool can be inserted, wherein the tool holder executes a rotational motion as a working motion. The drive means comprising the drive motor is set by means of actuating quantities or actuating signals of a closed-loop or open-loop control device.

The hand-held power tool has a sensor device, by means of which a user-generated actuating motion, in particular a rotational motion and/or axial motion, of at least a part of the hand-held power tool can be determined. The determined actuating motion is used as the basis for setting the drive means, in that an actuating quantity, which serves as an input quantity for the drive means, is generated from the actuating motion, in the closed-loop or open-loop control device in the hand-held power tool. The drive motor, which is a constituent part of the drive means, is controlled by closed-loop or open-loop control on the basis of the actuating quantity. In this case, the actuating motion—a rotational motion and/or an axial motion—of the hand-held power tool, which is detected by sensor means, constitutes an actual quantity.

The actuating motion relates to the motion of at least a part of the hand-held power tool, in particular of the hand-held power tool as a whole, in distinction from an actuation of a press switch or pushbutton, which, in the case of drills or battery-powered screwdrivers, for example, is used to set the rotational speed of the motor. In the case of the hand-held power tool according to the disclosure, by contrast, the motion of at least a part of the hand-held power tool, or of a substantial part of the hand-held power tool, in particular the hand-held power tool as a unit, is determined, which motion is defined by the user, in guiding and holding the housing of the hand-held power tool. By contrast, it is not a matter of actuation of the press switch or pushbutton. Possible motions are both absolute motions in space and relative motions, in relation to a reference system, for example relative motions between a first part and a second part of the hand-held power tool. A part of a hand-held power tool is understood to mean, in particular, a region of a hand-held power tool, for example a region that constitutes the handle region, or a region that serves to accommodate at least one component of the drive train, e.g. a motor and/or transmission, or a region that constitutes the tool receiving region.

In a first embodiment, the actuating motion relates to a rotational motion of the hand-held power tool as a unit about its longitudinal axis, performed by the operator of the hand-held power tool. The rotational motion extends, for example, over an angle of maximally 180 degrees, in particular maximally 90 degrees, quite particularly maximally 45 degrees, wherein the rotational motion about the longitudinal axis can be effected in the clockwise or anti-clockwise direction. Since the hand-held power tool is rotated as a unit, by a particular angle about its longitudinal axis, by an operator, this rotational motion is similar to the rotational motion performed by an operator of a non-motorized hand-held power tool, e.g. of a hand-held screwdriver, in order to tighten or undo a screw, for example.

In an alternative embodiment, the actuating motion relates to a rotational motion about the longitudinal axis of only a first part of the hand-held power tool, which is mounted so as to be rotatable relative to a second part of the hand-held power tool. The first part of the hand-held power tool may be, for example, a handle region, which might comprise one or more components of the drive train. The second part of the hand-held power tool may be, for example, a tool receiving region that, apart from a tool holder, might comprise one or more components of the drive train.

The at least one sensor device is used to determine current states of the hand-held power tool, in particular motions of the housing of the hand-held power tool that ensue from an actuation by the operator and that are used for setting the drive means. The rotational speed, the torque and/or the direction of rotation can be set on the basis of the sensor information, wherein both stationary and quasi-stationary states having a constant value, and dynamic operations having a course of the motor characteristics that varies with time, can be set.

The sensor device is used to determine the current state of the hand-held power tool, which state represents a reaction to the actuation by the operator. It is thereby possible for motions executed on the hand-held power tool by the operator to be interpreted in an ergonomic manner, and for the actuating quantity for setting the drive means to be subsequently generated therefrom.

In this way, for example, motions initiated by the operator are guided to their completion, or intuitive actuating motions performed on the hand-held power tool by the operator are motor-assisted or implemented by motor.

A further advantage consists in that, in principle, it is no longer necessary to press rotational direction, switch-on or rotational-speed buttons or pushbuttons or switches in order to set the functions of the hand-held power tool.

There is no need for rotational-speed buttons, pushbuttons or switches, and there is also an absence of wear or failure limiting the service life of the same. Moreover, a tool according to one of the principles described here allows a fully closed housing. Apart from the rotating tool receiver, there are no openings in the tool housing through which dust, water or other fluids could enter.

Switch-on and switch-off functions, the direction of rotation, the rotational speed and/or the torque can be defined through corresponding axial and/or rotational motions of the hand-held power tool in the direction toward or away from the workpiece to be worked, or through rotational motions, for example, about the tool axis in the clockwise or anti-clockwise direction.

By means of the sensor device, it is possible to determine axial and/or rotational motions of the hand-held power tool, as absolute motions in space and/or as a relative motion between two parts, in particular components, of the hand-held power tool, in particular between a handle region and a tool receiving region. Insofar as only a single sensor is present, the rotational motion, or a quantity that correlates therewith, of at least a part of the hand-held power tool about the tool longitudinal axis can be sensed, advantageously, by means of this sensor. The sensor device in this case is, for example, a rotation-rate sensor, or an acceleration sensor, for determining an absolute rotational motion of the housing of the hand-held power tool or a relative rotation between two parts of the hand-held power tool. It is also possible for an axial, translational motion to be determined by means of an appropriate sensor, for example a force sensor or displacement sensor, by means of which an axial actuating motion, or a quantity derived therefrom, either of the entire hand-held power tool or an axial relative motion between two parts of the hand-held power tool, can be determined.

Various functions can be realized by means of the hand-held power tool according to the disclosure. The rotational speed, or the torque, of the drive motor, or of the tool, can be set in dependence on the rotational angle to which the operator rotates the hand-held power tool about the longitudinal axis. This is effected in such a manner, for example, that a greater rotation of the hand-held power tool, or of a part of the hand-held power tool, about the tool longitudinal axis results in a higher rotational speed. Furthermore, it is possible for the rotational speed to be configured in dependence on the speed of the rotational motion executed by the operator.

Further, the direction of rotation of the drive motor, and thus of the hand-held power tool, can be dependent on the direction of rotation in which the operator rotates the hand-held power tool, or a part of the hand-held power tool, about its longitudinal axis. This can be effected, for example, in a manner analogous to that of a non-motorized hand-held screwdriver, which, for the purpose of tightening a screw, is rotated in one direction by the operator and, for the purpose of undoing a screw, is rotated in the other direction.

According to a further embodiment, for a given same displacement behavior of the user, the rotational speed and torque are dependent on the direction of rotation, in order, for example, to provide a higher torque for screwing-in a screw than for unscrewing the screw.

According to yet another embodiment, a constant rotational speed can be realized, irrespective of the working load, by means of the closed-loop or open-loop control device, provided that the user intention, generated by the operator through the motion of the hand-held power tool, does not alter. This enables the rotational speed to be kept constant, for example during unscrewing of a screw, despite a lesser torque requirement.

In a further embodiment, the rotational speed can be kept as constant as possible, even if the supply voltage is reduced.

Rotation of the hand-held power tool, or a part of the hand-held power tool, by the user can cause the rotational speed to be increased, in that a slow rotation of the hand-held power tool about the tool longitudinal axis results in a higher rotational speed.

By means of the closed-loop or open-loop control device, it is possible to realize a torque switch-off, at which the hand-held power tool switches off if the screw has been fully screwed in.

Identification of racing is also possible. If, during screwing-in of a screw, the torque increases and subsequently decreases, it can be inferred from this that the screw hole has cracked or that a possibly present dowel is turning concomitantly. In the case of an abrupt discontinuity of the torque, a destroyed, possibly broken-off, screw can be inferred. In both of these cases, a fault can be output, for example as a message on a display or via a warning lamp. The change in the torque can also be identified, without a torque measurement, through change in the rotation rate, since the user builds up, in the direction opposite to that of the tool torque, a holding torque that behaves inertially in the case of rapid changes in torque. Moreover, the delivered torque can also be inferred through direct measurement of current, or through the concomitantly calculated model in an observer.

Furthermore, it is possible to determine rattling of the tool, in particular through measurement of the rotation rate, or a rotational acceleration. Such a rattling behavior indicates a slipping tool, e.g. a worn screwdriver bit on a screwdriver head, or a tool that is no longer properly seated in the tool holder.

According to an advantageous embodiment, precisely one user-generated actuating motion of at least a part of the hand-held power tool is detected by means of the sensor device, and is used as the basis for setting the drive means. The one actuating motion relates, in particular, to a rotational motion of the hand-held power tool as a unit about its longitudinal axis, or, alternatively, a rotational motion of a part of the hand-held power tool, e.g. a handle region, relative to another part of the hand-held power tool, e.g. a tool receiving region, wherein the rotational motion is performed by the operator of the hand-held power tool. Also possible in principle, however, is an embodiment in which a first sensor device is used to measure a first actuating motion, and a second sensor device is used to measure a second actuating motion, of at least a part of the hand-held power tool, which actuating motion is generated by the user. Both actuating motions are used for setting the drive means. The actuating motions can be effected both consecutively and simultaneously. Furthermore, two translational, two rotational, or mixed translational and rotational motions may occur. Also possible are more than two actuating motions, which are determined by sensor means and used as a basis for controlling the hand-held power tool by open-loop or closed-loop control.

In an advantageous embodiment, a first sensor device detects an axial motion as a first actuating motion, and a second sensor device detects a rotational motion as a second actuating motion. In this case, the axial motion may represent an axial motion of the hand-held power tool as a unit or a relative motion between a first part of the hand-held power tool, e.g. a tool receiving region, and a second part of the hand-held power tool, e.g. a handle region. The axial motion as a relative motion between two parts of the hand-held power tool can additionally be an axial motion between a tool holder and a tool receiving region. The rotational motion can likewise represent either a rotational motion of the hand-held power tool as a unit or a rotational motion between a first part of the hand-held power tool, e.g. a tool receiving region, and a second part of the hand-held power tool, e.g. a handle region. In a particularly preferred embodiment, the first sensor device detects a first actuating motion that is an axial motion between a first part of the hand-held power tool, e.g. a tool receiving region, and a second part of the hand-held power tool, e.g. a handle region. The second sensor device detects a second rotational motion, which is a rotational motion of the hand-held power tool as a unit, or as a whole.

According to an advantageous embodiment, a handle region of the hand-held power tool is mounted so as to be rotatable relative to a tool receiving region, about the tool axis. The tool receiving region has an assigned first sensor device, by means of which the motion of the tool receiving region can be determined. The handle region has an assigned second sensor device, by means of which the rotational angle of the handle region, or a quantity that correlates with the rotational angle, can be detected. A tool receiving region is understood to mean a housing region that comprises at least the tool receiver, and possibly also one or more components of the drive train.

By means of the sensor devices, therefore, at least two additional items of information are available, which can be used for setting the drive means. As a result, even comparatively complex actuating motions of the operator can be sensed and converted into a corresponding actuation of the drive means.

The two sensor devices are preferably used to determine differing motions of the tool receiving region and of the handle region, respectively. According to an advantageous embodiment, it is provided that the axial motion of the tool receiving region, or a quantity that correlates with the axial motion, for example time derivatives of the axial motion, or the pressing force, resulting from the axial motion, between the tool held in the tool receiving region and the workpiece to be worked, or a fastening element such as, for example, a screw, can be determined by means of the first sensor device. It is also possible for only the contact between the first sensor device and the workpiece to be worked, or the fastening element, to be determined, for example electrically, in that a change in the electrical field, or the capacitance, is registered.

The axial motion that can be detected by means of the first sensor device may also possibly relate to the relative displacement between the tool receiving region and the handle region. Insofar as the tool receiving region and the handle region are coupled to each other in an axially displaceable manner, and are preferably at the same time supported in the axial direction by means of a spring element, a pressing operation of the power tool can also be detected, on the basis of the axial relative displacement, on the basis of a quantity that correlates therewith, between the tool receiving region and the handle region. Also possible is an axial relative motion between the tool holder and the tool receiving region; in this case, the tool holder is mounted so as to be adjustable in the tool receiving region.

The tool receiving region and the handle region execute motions that are basically independent of each other, and that can be determined by means of the respective sensor devices. As previously described, the motion of the tool receiving region is preferably an axial motion in the direction of the tool axis, whereas the motion of the handle region is expediently a rotational motion about the tool axis. The rotational motion is determined on the basis of the rotational angle, or a quantity that correlates therewith. The rotational motion of the handle region may denote both a rotation of the entire tool in space and a relative motion between the handle region and the tool receiving region; in the latter case, the relative rotational motion can be determined on the basis of a measurement of the relative rotational angle or a quantity derived therefrom, for example, the moment between the handle region and the tool receiving region. In the case of a connection between the handle region and the tool receiving region that allows a relative rotational motion, these two components are expediently supported against each other in a resilient manner.

The connection between the handle region and the tool receiving region, with the possibility of a relative motion, preferably relates only to the respective housing parts in the handle region and tool receiving region, respectively, but not to the drive train itself, which comprises the drive means, a transmission and the tool holder for receiving the tool. In this case, there must also be a relative motion between the drive train and at least either the handle region and the tool receiving region. Advantageously, the drive train is fixedly connected to the tool receiving region, whereas the handle region can execute a relative rotational motion relative to the parts of the drive train that are accommodated in the handle region.

If appropriate, however, the drive train is realized such that differing parts of the drive train can also execute a relative motion in relation to each other. In this case, the handle region and the tool receiving region can be fixedly connected to the respectively accommodated parts of the drive train.

In the case of a method for operating a hand-held power tool having a sensor device for determining a user-generated actuating motion of the hand-held power tool, the actuating motion is used as a basis for generating an actuating quantity for setting the drive means.

In the case of a method for operating a hand-held power tool equipped with a handle region and a tool receiving region and respectively assigned sensor devices, a pressing or contacting of the tool on to the workpiece, or on to the fastening element, is detected by means of the first sensor device, in a first step, whereupon the drive means is made ready for starting. In a succeeding step, the handle region is rotated by the operator, wherein the rotational motion is detected, by means of the second sensor device, as being either absolute in space or relative to the tool receiving region. The drive means is thereupon started, wherein the rotational speed and/or the torque of the drive means, and, if appropriate, also further determining quantities, in particular the direction of rotation, are set as a function of the signals of the sensor device, in dependence on the determined measurement values.

By means of this method, for example, a screw can be placed on to a workpiece and screwed in by means of a battery-powered screwdriver. The pressing of the battery-powered screwdriver on to the screw and the workpiece is registered by means of the first sensor device. Since the torsional resistance of the screw is still very low, because the screw is resting with only its tip on the workpiece, the handle region and the tool receiving region do not rotate relative to each other when the operator swivels the battery-powered screwdriver at the handle region, or about the tool axis. For the purpose of starting the screwdriving operation, the battery-powered screwdriver is rotated clockwise about the tool axis—in the screwdriving direction—at the handle region, this rotation being registered by means of the second sensor device. Since the handle receiving region and the tool receiving region do not execute a relative motion in relation to each other, the initial situation, in which the screw has not yet been screwed into the workpiece, can be identified. The screwdriving operation is then started automatically at a torque and a rotational speed that are specially adapted to the situation of starting to drive a screw into a workpiece.

If the screw has already been partially screwed into a workpiece and the battery-powered screwdriver is then applied, the contact between the tool in the tool receiving region and the screw is again first registered by means of the first sensor device, and the drive motor is made ready for starting. In the case of a manually executed relative motion of the handle region about the tool axis, the handle region will execute a relative rotational motion in relation to the tool receiving region, owing to the high torsional resistance of the screw in the workpiece. The moment produced in this case can be registered by means of the second sensor device. The screwdriving operation is then started automatically, wherein the rotational speed and the torque are matched to the higher torsional resistance.

According to a further advantageous embodiment, the hand-held power tool is realized as a unit, in which only the driven tool receiver is mounted so as to be rotatable about the tool axis. By means of an inertial sensor device in the hand-held power tool, quantities that correlate with actuating motions of the operator, in respect of direction of rotation, rotational angle and/or rotational speed in space, can be sensed and converted into a corresponding actuation of the drive means.

BRIEF DESCRIPTION OF THE DRAWINGS

Further advantages and expedient embodiments are given by the description of the figures and the drawings. In the drawings.

DETAILED DESCRIPTION

In the figures, components that are the same are denoted by the same references.

Figure 1:
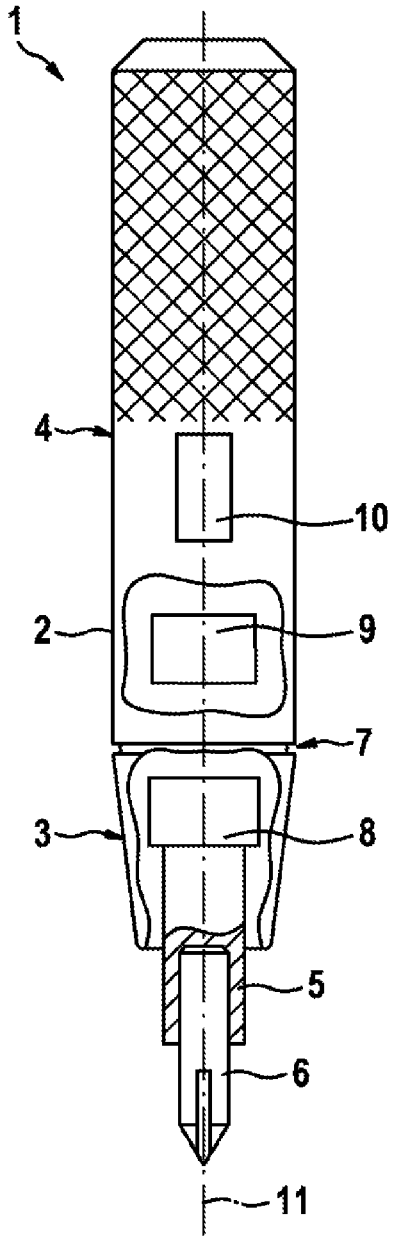
FIG. 1 shows a schematic representation of a hand-held power tool, realized as a battery-powered screwdriver, having an approximately cylindrical housing, which has a front tool receiving region and a rear handle region, wherein the handle region is rotatable relative to the tool receiving region, and a respective sensor device is disposed in both the tool receiving region and the handle region.
Figure 2:
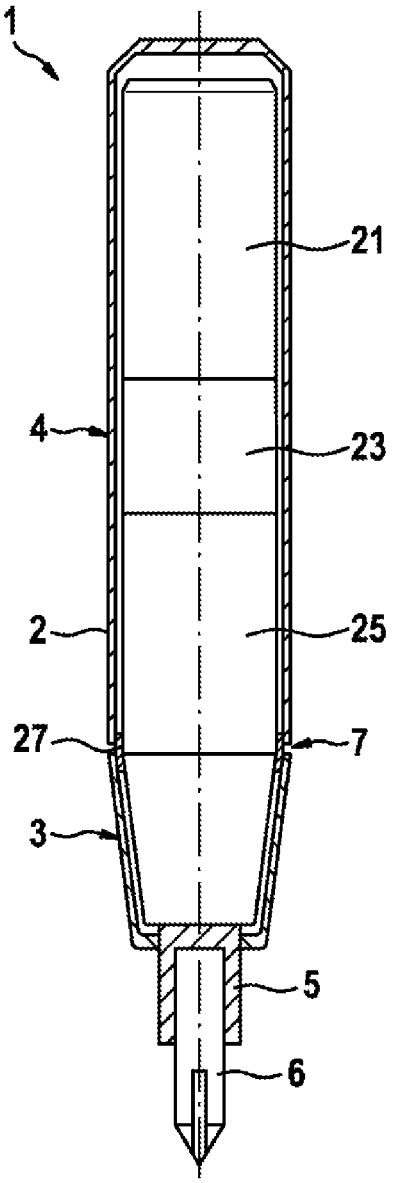
FIG. 2 shows a sectional representation of the hand-held power tool according to FIG. 1.

The hand-held power tool 1 according to FIGS. 1 and 2 has a two-part housing 2, which comprises a front tool receiving region 3 and a rear handle region 4, wherein the handle region 4 is realized so as to be rotatable, about the tool axis, or longitudinal axis, relative to the tool receiving region 3. The housing 2 accommodates at least one battery cell 21 and a drive means, in particular a battery-operated electric motor 23, which, together with a transmission 25 and a tool holder 5 that is disposed in the tool receiving region 3, constitutes a drive train. The tool holder 5 serves to receive an insert tool 6, for example a screwdriver bit.

The maximum relative rotational angle between the tool receiving region 3 and the handle region 4 is preferably only a few degrees, for example maximally plus/minus 10° or plus/minus 20°, relative to an initial, or neutral, position. Between the tool receiving region 3 and the handle region 4 there is a spring element 27, which exerts a spring moment in the direction of rotation. The spring moment holds the handle region 4 in the initial, or neutral, position relative to the tool receiving region 3, provided that there are no external forces or moments acting upon the hand-held power tool. The relative rotational motion between the tool receiving region 3 and the handle region 4 occurs in the transitional region 7 between these two components. The spring element 27 is also expediently disposed in the transitional region 7.

Disposed in the tool receiving region 3 is a first sensor device 8, by means of which a first actuating motion, here an axial motion of the tool receiving region 3, or a quantity derived therefrom, can be determined. In particular, it is possible for a pressing force to be detected by means of the sensor device 8 as the insert tool 6 applied to and pressed against a fastening element such as, for example, a screw. The pressing force acts in the direction of the tool axis 11.

In the handle region 4 there is a second sensor device 9, by means of which a second actuating motion, here the relative rotational angle of the handle region 4 relative to the tool receiving region 3, can be detected. Additionally or alternatively, an absolute rotation of the hand-held power tool 1 in space can also be detected, if appropriate, by means of the second sensor device 9. The second sensor device 9 is realized as a rotation-rate sensor.

Also provided is a main switch 10, by means of which the hand-held power tool is switched on and off. The main switch 10 serves to activate and deactivate electronic components (not represented) of the hand-held power tool 1, e.g. the sensor devices 8, 9. The main switch 10 is used to make the hand-held power tool 1 as a whole ready for starting. The activation of the main switch 10 does not yet start the electric motor 23. The main switch 10 therefore does not serve to activate and deactivate the electric motor 23, or to set the direction of rotation of the electric motor 23, and thus of the tool holder 5 (clockwise/anti-clockwise rotation). If the main switch 10 is deactivated, the electric motor cannot be started, and the hand-held power tool 1 as a whole cannot be operated. In a simple embodiment, the main switch 10 can be realized as a manually actuated switch.

The contact between the insert tool 6 and the workpiece, or the fastening element, is detected by means of the first sensor device 8, as a result of which the second sensor device 9 is activated, or the drive means is made ready for starting.

The sensor device 9 in the handle region 4 is calibrated to the neutral, or initial, position, and can detect displacements of the handle region 4 out of the neutral position, in both directions. As a result, it is possible for the direction of rotation of the drive means to be controlled automatically, in dependence on an actuating motion of the handle region by the operator. Accordingly, the direction of rotation of the drive means ensues from the direction in which the handle region 4 is rotated by the operator. This has the advantage that the operator can set the direction of rotation of the drive means without having to actuate a rotational-direction switch on the hand-held power tool. This additionally has the advantage that the operator can intuitively set the direction of rotation of the drive means, in a manner analogous to the handling of a non-motorized hand-held screwdriver. Furthermore, the amount of rotational displacement, which is used as the basis for control of the rotational speed, or torque, of the drive means, is determined as a result of the determination of the torque and/or relative rotational angle between the handle region 4 and the tool receiving region 3.

Figure 3:
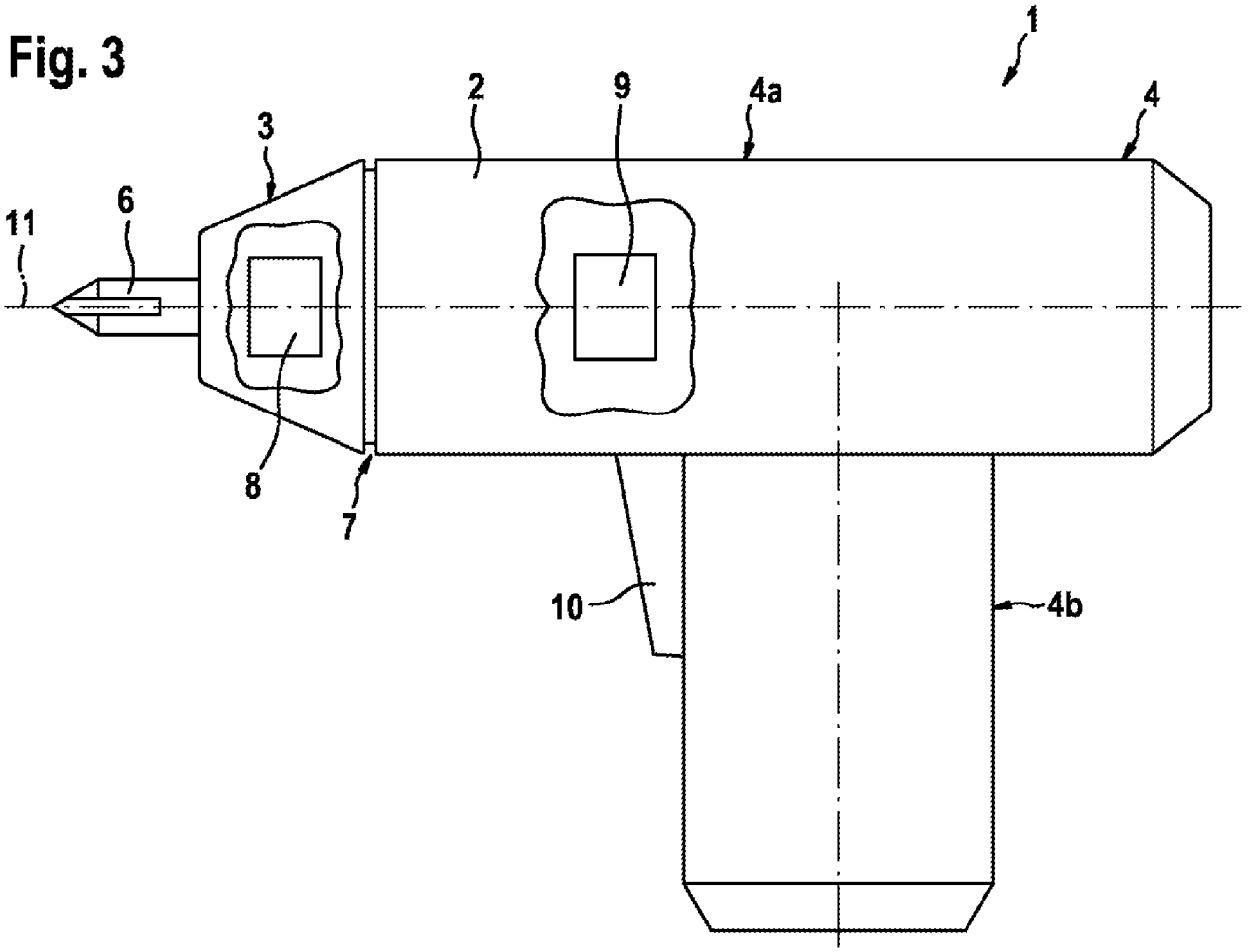
FIG. 3 shows a schematic representation of a further exemplary embodiment, with a hand-held power tool whose handle region extends in part perpendicularly in relation to the tool axis.

As compared with the first exemplary embodiment, the hand-held power tool 1 according to the exemplary embodiment shown in FIG. 3 differs only in the geometry of the housing 2. As in the first exemplary embodiment according to FIGS. 1 and 2, the handle region 4 is mounted so as to be rotatable relative to the tool receiving region 3, about the tool axis 11. The handle region 4 has a motor-accommodating portion 4*a*, which is approximately cylindrical in form and whose axis coincides with the tool axis 11. Furthermore, the handle region 4 has a handle 4*b*, which extends substantially at right angles to the motor-accommodating portion 4*a*, and on which the main switch 10 is disposed. The relative rotational motion of the handle region 4 about the tool axis 11, relative to the tool receiving region 3, which comprises the first sensor device 8, is registered by means of the second sensor device 9. The first sensor device 8, by contrast, serves to detect an axial pressing force of the tool 6 against a workpiece or a fastening element.

In other respects, the structure and the functions of the second exemplary embodiment according to FIG. 3 are the same as in the case of the first exemplary embodiment according to FIGS. 1 and 2.

Figure 4:
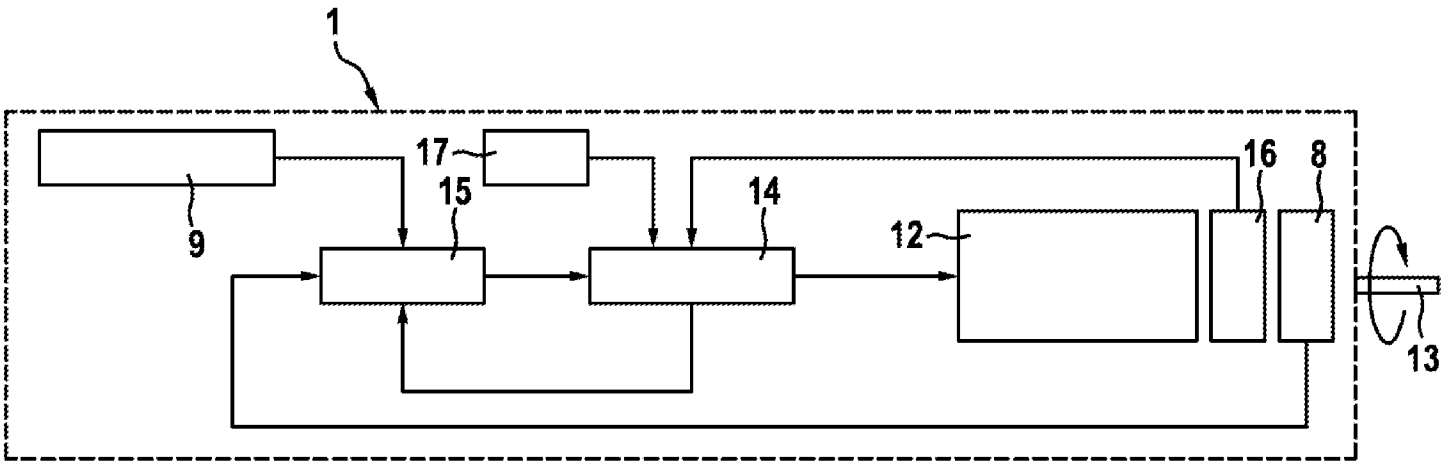
FIG. 4 shows a system diagram giving a schematic representation of the components of a hand-held power tool.

FIG. 4 shows a system diagram of a hand-held power tool, realized as a battery-powered screwdriver, with the various components, which are represented symbolically. The hand-held power tool 1 has a drive means 12, which comprises an electric drive motor, as well as a transmission that is assigned to the motor. A tool shaft 13, for receiving a tool of the hand-held power tool, is driven by means of the drive means 12. Power electronics 14 apply a control voltage to the electric motor of the drive means 12, wherein the power electronics 14 have an assigned closed-loop or open-loop control device 15 for generating an actuating quantity. The closed-loop or open-loop control device 15 receives, as input signals, sensor-determined data from sensor devices 8 and 9, wherein the sensor device 8 is, for example, an encoder for determining the rotational speed of the tool shaft 13, and the second sensor device 9 being a rotation-rate sensor for determining the rotational motion of the hand-held power tool in space. By means of the sensor device 8, it is possible to determine the current operating state of the hand-held power tool, in particular whether the hand-held power tool is switched on and whether the tool shaft is revolving or at a standstill. By means of the rotation-rate sensor, it is possible to determine a spatial actuating motion exerted upon the hand-held power tool by a user. As an alternative to a rotation-rate sensor, as a second sensor device 9, it is also possible to use two acceleration sensors (not represented). For this purpose, the acceleration sensors are disposed in a plane perpendicular to the tool axis, wherein the two acceleration sensors are opposite each other, equidistantly in relation to the tool axis.

Optionally, a current rated according to the power electronics 14 can be supplied, as an input quantity, to the closed-loop or open-loop control device 15.

In the closed-loop or open-loop control device 15, an actuating quantity is determined from the input quantities, which actuating quantity is supplied, as a setpoint value, to the power electronics 14, in order to generate the required value of the voltage to be applied to the electric motor of the drive means 12.

The power electronics 14 has an assigned battery 17 for supplying electric current. In addition, a switch signal of a switch 16 can be supplied, as an input value, to the power electronics 14, wherein the switch signal represents the current on/off state of the hand-held power tool. This signal can also be supplied to the closed-loop or open-loop control device 15 if appropriate.

As an alternative to determination by sensor means, a quantity, or a plurality of quantities, can also be determined by means of an observer model. This relates, for example, to the value of the current in the power electronics 14, which is optionally supplied as an input quantity to the closed-loop or open-loop control device 15.

Figure 5:
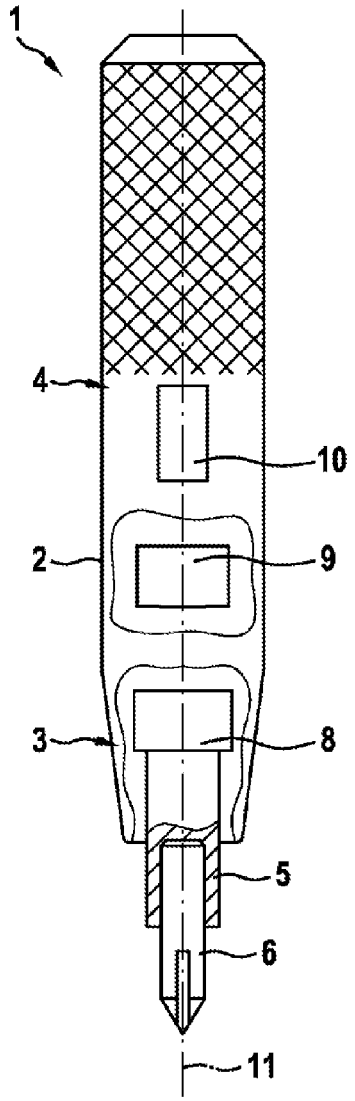
FIG. 5 shows a schematic representation of a further exemplary embodiment, with a hand-held power tool having an integrally realized housing.
Figure 6:
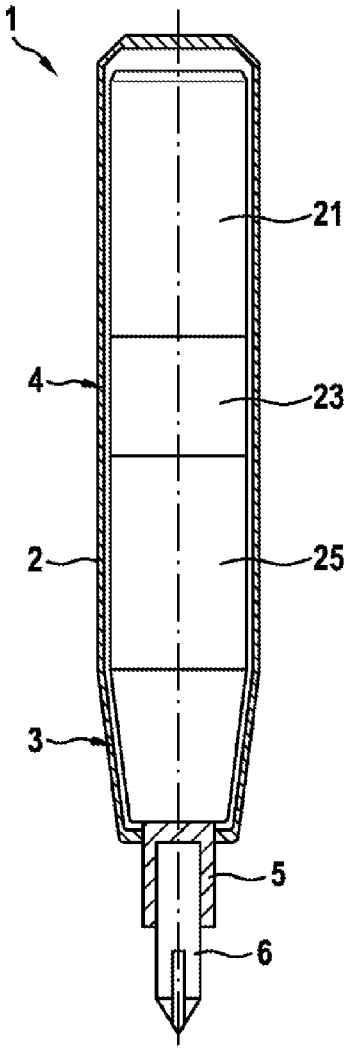
FIG. 6 shows a sectional representation of the hand-held power tool according to FIG. 5.

In respect of form and type, the hand-held power tool 1 according to FIGS. 5 and 6 is realized as straight screwdriver, and has a housing 2, which comprises a front tool receiving region 3 and a rear handle region 4. The housing 2 accommodates at least one battery cell 21 and a drive means, in particular a battery-operated electric motor 23, which, together with a transmission 25 and a tool holder 5 that is disposed in the tool receiving region 3, constitutes a drive train. The tool holder 5 serves to receive an insert tool 6, for example a screwdriver bit. Unlike the embodiment according to FIGS. 1 and 2, in the embodiment according to FIGS. 5 and 6 the tool receiving region 3 and the handle region 4 are not mounted so as to be rotatable in relation to each other. The housing 2 is realized so as to be rigid, in particular as a single, integral part, in the transitional region between the tool receiving region 3 and the handle region 4.

Disposed in the hand-held power tool 1 is a sensor device 8, by means of which an axial motion of the tool holder 5 relative to the hand-held power tool, or a quantity derived therefrom, can be determined. In particular, it is possible for a pressing force to be detected by means of the sensor device 8 as the insert tool 6 fitted and pressed against a fastening element such as, for example, a screw. The pressing force acts in the direction of the tool axis 11.

In the handle region 4 there is a second sensor device 9, by means of which the direction of rotation, rotational angle and/or rotational speed of the hand-held power tool 1 is determined, as a unit in space. The determined sensor values can be both absolute in space, for example in relation to the direction of gravitational acceleration, and also relative to a preceding state; in the latter case, this is, for example, the rotation rate. The second sensor device 9 is realized as a rotation-rate sensor.

Also provided is a main switch 10, by means of which the hand-held power tool is switched on and off. The functioning of the main switch 10 corresponds substantially to the functioning of the main switch of the embodiment according to FIGS. 1 and 2.

The contact between the tool 6 and the workpiece, or the fastening element, is detected by means of the first sensor device 8, as a result of which the second sensor device 9 is activated, or the drive means is made ready for starting.

The sensor device 9 in the handle region 4 can be calibrated to the neutral, or initial, position, for example at the instant of making ready for starting, and can detect displacements of the handle region 4 out of the neutral position, in both directions. As a result, it is possible for the direction of rotation of the drive means to be controlled automatically, in dependence on an actuating motion of the handle region 4, and therefore of the hand-held power tool 1 as a whole, by the operator. Furthermore, the control of the rotational speed, or torque, of the drive device is effected as a result of the determination of the rotation rate and/or of the rotation angle of the hand-held power tool 1 in space.

A hand-held power tool according to the exemplary embodiment as in FIG. 6 may likewise have a geometry of the housing 2 according to FIG. 3.

The invention claimed is:

1. A hand-held power tool, comprising:

a housing including a handle region and a tool receiving region;

a drive mechanism disposed in the housing and configured to drive a tool received in a tool holder of the tool receiving region;

power electronics configured to supply power to the drive mechanism, the power being supplied to the drive mechanism based on a setpoint value; and a sensor device configured to determine a user-generated actuating motion of at least a part of the hand-held power tool; and a closed-loop or open-loop control device in the hand power tool device configured to generate an actuating quantity from the determined actuating motion, the actuating quantity being supplied to the power electronics as the setpoint value, wherein the user-generated actuating motion results in a relative motion of a first part of the hand-held power tool with respect to a second part of the hand-held power tool, wherein the user-generated actuating motion is a rotational motion about a tool longitudinal axis, wherein the first part corresponds to the handle region and the second part corresponds to the tool receiving region, wherein the user-generated actuating motion is a relative rotation between the handle region and the tool receiving region caused by a user of the tool, and wherein the sensor device includes a rotation-rate sensor configured to determine a rotational motion, or a quantity that correlates therewith, of the first part with respect to the second part.

2. The hand-held power tool as claimed in claim 1, wherein the sensor device is configured to determine a direction of rotation of the rotational motion.

3. The hand-held power tool as claimed in claim 1, wherein the sensor device is configured to determine a rotational angle, a rotation rate and/or a torque of the rotational motion.

4. The hand-held power tool as claimed in claim 1, wherein the sensor device is configured to determine a relative rotational angle, or a torque, between the tool receiving region and the handle region.

5. The hand-held power tool as claimed in claim 1, wherein the sensor device is configured to determine an absolute rotational angle of the handle region in space.

6. The hand-held power tool as claimed in claim 1, wherein a direction of rotation of the drive mechanism is set by the actuating quantity generated in the closed-loop or open-loop control device.

7. The hand-held power tool as claimed in claim 1, wherein a rotational speed and/or a torque of the drive mechanism is set by the actuating quantity generated in the closed-loop or open-loop control device.

8. The hand-held power tool as claimed in claim 1, wherein the user-generated actuation motion is an axial motion.

9. The hand-held power tool as claimed in claim 8, wherein the first part corresponds to the handle region and the second part corresponds to the tool receiving region, and wherein the axial motion is a relative motion between the tool receiving region and the handle region.

10. The hand-held power tool as claimed in claim 8, wherein the first part corresponds to the tool holder and the second part corresponds to the tool receiving region, and wherein the axial motion is a relative motion between the tool holder and the tool receiving region.

11. The hand-held power tool as claimed in claim 1, wherein the sensor device is configured to determine an axial motion of the tool receiving region, or a quantity that correlates to the axial motion.

12. The hand-held power tool as claimed in claim 1, wherein the sensor device is configured to determine an axial pressing force of the tool receiving region.

13. The hand-held power tool as claimed in claim 1, wherein the sensor device is configured to determine contact between the tool and a workpiece to be worked, or a fastening element.

14. The hand-held power tool as claimed in claim 1, wherein the sensor device comprises a first sensor device and a second sensor device, wherein the user-generated actuating motion comprises a first user-generated actuating motion and a second user-generated actuating motion, and wherein the first sensor device is configured to determine the first user-generated actuating motion and the second sensor device is configured to determine the second user-generated actuating motion.

15. The hand-held power tool as claimed in claim 14, wherein the first user-generated actuating motion is an axial motion of the tool receiving region, and the second user-generated actuating motion is a rotational motion of the handle region relative to the tool receiving region.

16. The hand-held power tool as claimed in claim 1, wherein the sensor device comprises a first sensor device and a second sensor device, and wherein the first sensor device is configured to determine motion of the tool receiving region and the second sensor device is configured to determine motion of the handle region.

17. The hand-held power tool as claimed in claim 16, wherein the handle region is mounted so as to be adjustable relative to the tool receiving region.

18. The hand-held power tool as claimed in claim 16, wherein the second sensor device is configured to determine a rotational angle, or a quantity that correlates to the rotational angle, of the handle region.

19. A hand-held power tool, comprising:

a housing including a handle region and a tool receiving region;

a drive mechanism disposed in the housing and configured to drive a tool received in a tool holder of the tool receiving region;

power electronics configured to supply power to the drive mechanism, the power being supplied to the drive mechanism based on a setpoint value; and a sensor device configured to determine a user-generated actuating motion of at least a part of the hand-held power tool; and a closed-loop or open-loop control device in the hand power tool device configured to generate an actuating quantity from the determined actuating motion, the actuating quantity being supplied to the power electronics as the setpoint value, wherein the user-generated actuating motion results in a relative motion of a first part of the hand-held power tool with respect to a second part of the hand-held power tool, wherein the user-generated actuating motion is a rotational motion about a tool longitudinal axis, wherein the first part corresponds to the handle region and the second part corresponds to the tool receiving region, wherein the user-generated actuating motion is a relative rotation between the handle region and the tool receiving region caused by a user of the tool, and wherein the sensor device includes an acceleration sensor configured to determine a rotational motion, or a quantity that correlates therewith, of the first part.

20. A hand-held power tool, comprising:

a housing including a handle region and a tool receiving region;

a drive mechanism disposed in the housing and configured to drive a tool received in a tool holder of the tool receiving region;

power electronics configured to supply power to the drive mechanism, the power being supplied to the drive mechanism based on a setpoint value; and a sensor device configured to determine a user-generated actuating motion of at least a part of the hand-held power tool; and a closed-loop or open-loop control device in the hand power tool device configured to generate an actuating quantity from the determined actuating motion, the actuating quantity being supplied to the power electronics as the setpoint value, wherein the user-generated actuating motion results in a relative motion of a first part of the hand-held power tool with respect to a second part of the hand-held power tool, wherein the user-generated actuating motion is a rotational motion about a tool longitudinal axis, wherein the first part corresponds to the handle region and the second part corresponds to the tool receiving region, wherein the user-generated actuating motion is a relative rotation between the handle region and the tool receiving region caused by a user of the tool, and wherein a spring element is disposed between the tool receiving region and the handle region, the spring element exerting a spring force in the direction of rotation to hold the handle region in a neutral position relative to the tool receiving region if no external force acts upon the handle region.

21. A hand-held power tool, comprising:

a housing including a handle region and a tool receiving region;

a drive mechanism disposed in the housing and configured to drive a tool received in a tool holder of the tool receiving region;

power electronics configured to supply power to the drive mechanism, the power being supplied to the drive mechanism based on a setpoint value; and a sensor device configured to determine a user-generated actuating motion of at least a part of the hand-held power tool; and a closed-loop or open-loop control device in the hand power tool device configured to generate an actuating quantity from the determined actuating motion, the actuating quantity being supplied to the power electronics as the setpoint value, wherein the user-generated actuating motion results in a relative motion of a first part of the hand-held power tool with respect to a second part of the hand-held power tool, wherein the sensor device comprises a first sensor device and a second sensor device, wherein the user-generated actuating motion comprises a first user-generated actuating motion and a second user-generated actuating motion, wherein the first user-generated actuating motion is an axial motion of the tool receiving region, and the second user-generated actuating motion is a rotational motion of the handle region relative to the tool receiving region, and wherein the first sensor device is configured to determine the first user-generated actuating motion and the second sensor device is configured to determine a second user-generated actuating motion.

* * * * *